United States Patent [19]

Wisotsky

[11] 3,961,915

[45] June 8, 1976

[54] SYNERGISTIC ADDITIVE IN PETROLEUM MIDDLE DISTILLATE FUEL

[75] Inventor: Max J. Wisotsky, Highland Park, N.J.

[73] Assignee: Exxon Research and Engineering Company, Linden, N.J.

[22] Filed: Dec. 27, 1974

[21] Appl. No.: 536,723

[52] U.S. Cl. ..... 44/62; 44/66; 44/70; 208/38

[51] Int. Cl.[2] ..... C10L 1/20

[58] Field of Search ..... 44/58, 62, 70, 66; 208/33, 28

[56] References Cited

UNITED STATES PATENTS

| | | | |
|---|---|---|---|
| 2,023,369 | 12/1935 | Limburg | 208/19 |
| 2,209,168 | 7/1940 | Meyer | 208/33 |
| 3,048,479 | 8/1962 | Ilnyckyj et al. | 44/62 |
| 3,245,766 | 4/1966 | Lifson et al. | 44/62 |
| 3,444,082 | 5/1969 | Kautsky | 252/51.5 A |
| 3,649,228 | 3/1972 | McLaren | 44/66 |

*Primary Examiner*—Daniel E. Wyman
*Assistant Examiner*—Y. Harris-Smith
*Attorney, Agent, or Firm*—R. A. Dexter; Trank T. Johmann

[57] ABSTRACT

The low temperature filterability of a petroleum middle distillate fuel, such as a heating oil or a diesel fuel is improved by adding to the fuel a flow improving amount of wool fat and, if desired, a flow improving amount of wool fat in combination with oil-soluble, auxiliary flow-improving material such as: an alkyl aromatic, e.g., the condensation product of chlorinated wax and naphthalene; a polymer of an acrylic ester, such as polyalkyl acrylate; etc. This invention is particularly advantageous in improving the flow of a diesel fuel through a fine filter at low temperatures.

6 Claims, No Drawings

SYNERGISTIC ADDITIVE IN PETROLEUM MIDDLE DISTILLATE FUEL

BACKGROUND OF THE INVENTION

1. Field of the Invention

The invention relates to wool fat alone or in combination with oil-soluble auxiliary flow-improving material whereby the cold flow properties of middle distillate fuel oil are improved.

2. Description of the Prior Art

Kerosene, which is a solvent for wax, has traditionally been a component of middle distillate fuel oils, e.g. diesel fuels, home heating oils, etc. With the demands for kerosene for use in jet fuels, the amount of kerosene used in distillate fuel oils have decreased over the years. This, in turn, has frequently required the addition of wax crystal modifiers, e.g. pour point depressant additives, to the fuel oil to make up the lack of kerosene.

Included in the auxiliary flow-improving compounds are a class of lubricating oil pour point depressant additives, namely, alkylated aromatics, particularly the wax-naphthalene pour point depressants. These materials have been used in various petroleum oils, such as lubricating oils, e.g. see U.S. Pat. Nos. 1,815,022 and 2,297,292; as dewaxing aids, including use with other co-additives, e.g. see U.S. Pat. Nos. 3,417,010 and 3,475,321; and as pour depressants for middle distillate fuels, e.g. see U.S. Pat. No. 3,245,366.

A group of distillate fuel oil pour depressants are the copolymers of ethylene with various other monomers, e.g. copolymers of ethylene and vinyl esters of lower fatty acids such as vinyl acetate (U.S. Pat. No. 3,048,479); copolymers of ethylene and alkyl acrylate (Canadian Pat. No. 676,875); terpolymers of ethylene with vinyl esters and alkyl fumarates (U.S. Pat. Nos. 3,304,261 and 3,341,309); polymers of ethylene with other lower olefins, or homopolymers of ethylene (British Pat. Nos. 848,777 and 993,744); chlorinated polyethylene (Belgium Pat. Nos. 707,371 and U.S. Pat. No. 3,337,313); etc.

Wool fat has been added to hydrocarbon oils such as those originating from paraffin base crude petroleum and obtained by hydrogenation to appreciably reduce the pour point of such oils (U.S. Pat. No. 2,023,369). Lanolin or wool grease are taught to be capable of improving the filter rate of hydrocarbon oils and reducing the oil content of the wax cake in dewaxing operations (U.S. Pat. No. 2,099,190 and 2,209,168). Lubricating oil pour point depressants and dewaxing aids of hydrocarbon oils are generally found to exhibit little to no flow improving activity in middle distillate fuels.

U.S. Pat. No. 3,762,888 teaches improving the cold flow properties of middle distillate fuels with a combination of oil-soluble, pour point depressant polymers together with oil-soluble auxiliary, flow-improving compounds.

SUMMARY OF THE INVENTION

As opposed to the synthesized ethylene polymers of the aforesaid prior art, and unexpectedly in view of the art an animal product comprising long chained hydrocarbon esters of branched (iso) acids having from 9 to about 27 carbon atoms can be added to middle distillate oils to improve their low temperature flow. The aforementioned animal product, commonly called wool fat, is useful as a middle distillate flow improver alone or in combination with an alkyl aromatic or an ester base polymer or an alkenyl succinamic acid material or a copolymer of ethylene and a vinyl ester of a lower fatty acid or mixtures thereof.

Many of the aforedescribed prior art materials, while very effective in lowering the pour point of distillate fuel oil, sometimes do not sufficiently reduce the particle size of the wax crystals that form. These large wax particles tend to be filtered out by the screens and other filter equipment normally used on trucks and in fuel oil storage systems, etc., with a resulting plugging of these screens and filters even though the temperature of the oil is substantially above its pour point. In general, the additive wool fat and its combinations of the invention can control the wax crystal size most effectively compared to prior art materials.

Because of this increased effectiveness in regulating wax crystal size, the additives of the invention are particularly useful in diesel fuels in view of the current tendency and desire to increase the cloud point by raising the distillation temperature. One advantage of increasing the cloud point is that the resulting fuel will then contain a larger proportion of higher molecular weight hydrocarbons which in turn, increases the BTU value of the fuel. The greater BTU value gives economies during the operation of diesel engines, for example, diesel trucks.

The wax crystal size of these fuels will frequently need to be controlled. For example, in the normal operation of diesel trucks, the diesel engine is usually provided with a fine mesh filter of about 50 microns, e.g. about equivalent to a 270 mesh screen, ahead of the engine. In cold weather when the ambient temperature is below the cloud point, it becomes especially essential that the wax crystals that form are sufficiently fine so that they will pass through any filters. As previously indicated, the present invention provides an additive or combination of additives which can be used to reduce or regulate the wax crystal size to thereby obtain improved cold flow properties.

In general, the compositions of the invention will comprise a major amount of a distillate fuel oil improved in flow characteristics by a minor, flow-improving amount of wool fat alone or in combination with an oil-soluble, auxiliary flow compound, said combination being usually in relative ratios of 0.3 to 10, preferably 0.5 to 5 parts by weight of wool fat per part by weight of the auxiliary material.

THE DISTILLATE FUELS

In general the distillate fuel oils of the invention will boil in the range of 120°C. to 400°C. and will have cloud points usually from about −30°C. to about 5°C. The fuel oil can comprise straight run, or cracked gas oil, or a blend in any proportion of straight run and thermally and/or catalytically cracked distillates, etc. The most common petroleum middle distillate fuels are kerosene, diesel fuels, jet fuels and heating oils. The low temperature flow problem is most usually encountered with diesel fuels and with heating oils.

A typical heating oil distillate for which this invention is useful calls for a 10% distillation point of about 195°C., a 50% point of about 260°C., and a 90% point of about 350°C. and no higher than about 380°C.

A diesel fuel distillate for which this invention is useful has a wax content of 6.9 wt. % at −29°C., a 90% distillation point (ASTMD-1160) between 320°C. and 340°C., a −6°C. cloud point and a final boiling point of about 345°C.

The distillate fuel oil can comprise straight run or virgin gas oil or cracked gas oil or a blend in any proportion of straight run and thermally and/or catalytically cracked distillates. The most common petroleum middle distillate fuels are kerosene, diesel fuels, jet fuels and heating oils. Since jet fuels are normally refined to very low pour points, there will generally be no need to apply the present invention to such fuels. The low temperature flow problem is most usually encountered with diesel fuels and with heating oils.

Generally, there will be added to a middle distillate petroleum fuel from about 0.01 to about 3 weight percent, or more preferably from about 0.05 to about 0.75 weight percent of the additive of the invention. Concentrates of the additive can also be prepared containing from 3 to 60 weight percent of the additive in a hydrocarbon oil, as for example, a distillate fuel.

Anhydrous Wool Fat

Wool fat is a complex mixture of esters of water-insoluble alcohols and higher fatty acids. About 85% of the acids and 75% of the alcohols have now been identified. The acid fraction is unusual and contains very little of the straight chain fatty acids. Branched chain and hydroxy acids preponderate. The acids and the approximate percentages are as follows:

| Acid Type | Formula | % of Total |
|---|---|---|
| normal | $CH_3CH_2CH_2(CH_2)_nCH_2COOH$ | 7 |
| iso | $CH_3CH(CH_3)CH_2(CH_2)_nCH_2COOH$ | 22 |
| anteiso | $CH_3CH_2CH(CH_3)(CH_2)_nCH_2COOH$ | 29 |
| α-hydroxy | $CH_3CH_2CH_2(CH_2)_nCH(OH)COOH$ | 25 |
| α-hydroxy-iso | $CH_3CH(CH_3)CH_2(CH_2)_nCH(OH)COOH$ | 3 |
| unsaturated residue n=about 3 to about 23 | | ~14 |

The alcohol fraction is likewise a very complex mixture. Cholesterols constitute about 29% and isocholesterols about 27% of the fraction. Aliphatic alcohols are about 20% of the fraction and about 22% of the alcohol fraction is still unidentified. For a discussion of wool wax (also known as wool fat) reference should be made to Kirk-Ohmer Encyclopedia of Chemical Technology, Second Edition, Vol. 22, pp.411–415, published by John Wiley & Sons, Inc. New York, N.Y. which is incorporated herein by reference thereto.

Included within the concept of wool fat are known derivatives of wool fat and readily separable fractions of wool fat.

The Alkyl Aromatics

These materials are usually made by the Friedel-Crafts condensation of a halogenated paraffin or an olefin with an aromatic hydrocarbon. They are well known in the art, primarily as lube oil pour depressants and as dewaxing aids as previously mentioned. Usually, the halogenated paraffin will contain from about 15 to about 60, e.g. 16 to about 50 carbons, and from about 5 to about 25 wt. %, e.g. 10 to 18 wt. %, chlorine. Typically, the halogenated paraffins are prepared by chlorinating to the above recited chlorine content a paraffin wax having a melting point within the range of about 38° to 94°C. The aromatic hydrocarbon used usually contains a maximum of three substituent groups and/or condensed rings. It may be a hydroxy compound such as phenol, cresol, xylenol, or an amine such as aniline, but is preferably naphthalene, phenanthrene or anthracene.

Ester Base Polymers

Usually these oil-soluble ester base polymers will have molecular weights in the range of 5,000 to 1,000,000, preferably 10,000 to 500,000 and most preferably 15,000 to 200,000 average molecular weight % ($\overline{M}n$). These ester base polymers are derived essentially e.g., 80 wt. % or more of the total polymer, from $C_8$ to $C_{20}$, preferably $C_{12}$ to $C_{18}$, alkyl esters of a $C_3$ to $C_8$, preferably $C_3$ to $C_5$ mono- or dicarboxylic, monoethylenically unsaturated acid. Polymers of this ester type are well known in the art and are usually made by free radical initiation, e.g., a peroxide, in a solvent.

Such esters from which the polymer is essentially derived include: alkyl acrylate; alkyl methacrylate; dialkyl fumarate; and dialkyl itaconate.

The most common of these oil-soluble esters are polymers of acrylic esters represented by the formula

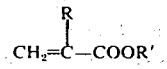

wherein R represents hydrogen or methyl and R′ represents an alkyl group of 8 to 24 carbon atoms. The alkyl group may be essentially straight chain and preferably contains 12 to 18 carbon atoms although methyl and ethyl branching can be tolerated. The term "acrylic ester" in this invention includes both acrylates and methacrylates. Mixtures of both alkyl acrylates and alkyl methacrylates may be used as well as their partial esters.

Lower alkyl acrylic esters, here meaning esters having alkyl groups smaller than 8 carbon atoms and derived from acrylic or methacrylic acid, i.e. methyl, ethyl, propyl, butyl, amyl, and hexyl acrylates and methacrylates may be employed in amounts ranging from 0 to 25 mole % with said $C_{8-24}$ alkyl esters.

In addition to the one or more of the above vinyl mono- and dicarboxylic esters and the aforementioned lower alkyl acrylic esters, there may be used to form the backbone, in minor amounts, one or more other miscellaneous free radical, polymerizable, monoethylenically unsaturated compounds, particularly monovinylidene compounds, i.e., those having one group in its structure, such as vinyl esters such as vinyl acetate, styrene and alkyl styrenes, vinyl alkyl ethers — which are represented by vinyl butyl ether, vinyl dodecyl ether and vinyl octadecyl ether.

In addition, nitrogen-containing monomers can be polymerized with the foregoing monomers, said nitrogen-containing monomers include those represented by the formula:

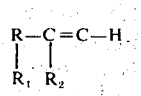

wherein $R_1$ and $R_2$ can be hydrogen and/or alkyl radicals and R is a 5- or 6-membered heterocyclic nitrogen-containing ring and which contains one or more substituent hydrocarbon groups. In the above formula, the vinyl radical can be attached to the nitrogen or to a carbon atom in the radical R. Examples of such vinyl derivatives include 2-vinylpyridine, 4-vinylpyridine, 2-methyl-5-vinylpyridine, 2-ethyl-5-vinylpyridine, 4-methyl-5-vinylpyridine, N-vinylpyrrolidone, 4-vinylpyrrolidone and the like.

Other monomers that can be included are the unsaturated amides such as those of the formula:

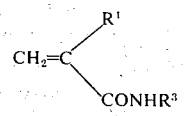

wherein $R^1$ is hydrogen or methyl, and $R^3$ is hydrogen or an alkyl radical having up to about 24 carbon atoms. Such amides are obtained by reacting acrylic acid or a low molecular weight acrylic ester with an amine such as butylamine, hexylamine, tetrapropylene, amine, cetylamine and tertiary-alkyl primary amines. The tertiary-alkyl primary amines referred to conform to the characterizing structure

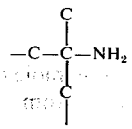

wherein a tertiary carbon atom, i.e., one devoid of hydrogen atoms is bonded to a primary amino radical, i.e., $—NH_2$. Such tertiary-alkyl primary amines should contain at least about 6 and generally not more than about 24 carbon atoms in the tertiary-alkyl substituent. In most instances, the tertiary-alkyl substituent will contain from about 10 to about 24 carbon atoms. Specific examples of tertiary-alkyl primary amines useful for the purposes of this invention include tertiary-octyl primary amine, tertiary-decyl primary amine and tertiary-hexadecyl primary amine, tertiary-eicosyl primary amine and tertiary-triacontyl primary amine. It is not necessary to use a single tertiary-alkyl primary amine; in fact, it is generally more convenient to use a commercial mixture of such amines wherein the tertiary-alkyl substituent contains from about 10 to about 24 carbon atoms. A typical mixture of such commercial tertiary-alkyl primary amines, for example, consists of tertiary-alkyl primary amines containing from about 10 to 14 carbon atoms, said mixture averaging about 12 carbon atoms per amine molecule.

Still other monomers that can be included are amides and mixed amides-esters of the vinyl monocarboxylic and dicarboxylic acids earlier referenced herein. These monomers and the earlier discussed lower alkylacrylic esters, monovinylidene compounds, nitrogen-containing monomers and unsaturated amides may individually or collectively be employed in total amounts ranging from 0 to 25 mole % with said $C_{8-24}$ alkyl esters.

The Succinamic Acid Materials

A description of these materials is given in U.S. Pat. Nos. 3,444,082 and 3,544,467, which description is as follows:

The alkenyl succinamic acids preferably (n-aliphatic hydrocarbyl) succinamic acids will, for the most part, have the following formula:

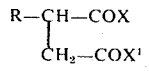

wherein R is a straight chain aliphatic hydrocarbon group having from 0 to 1 sites of olefinic unsaturation (alkyl or alkenyl) attached at a secondary carbon atom to the succinyl group and is of at least 14 carbon atoms, generally in the range of 15 to 40 carbon atoms and more usually in the range of 15 to 30 carbon atoms. One of X and $X^1$ is hydroxyl and the other is:

$$—NYY^1$$

wherein N has its normal meaning of nitrogen and Y and $Y^1$ are aliphatic hydrocarbyl groups of from 14 to 40 carbon atoms, more usually of from 15 to 30 carbon atoms, having a total of from about 30 to 52 carbon atoms, more usually of from 32 to 48 carbon atoms, and, preferably, of from 32 to 40 carbon atoms.

Y and $Y^1$ can be aliphatically saturated or aliphatically unsaturated, generally free of acetylenic unsaturation (alkyl or alkenyl). There may be from 1 to 2 sites of olefinic unsaturation. Y and $Y^1$ may be the same or different and may be straight chain or branched chain, preferably straight chain. The branches will normally be not greater than 1 carbon atom, i.e., methyl. The position of attachment to nitrogen may be at a terminal or internal carbon atom.

As is evidenced from the above formula, it is not important which position the alkyl or alkenyl group has in relation to the carboxamide or carboxyl group. Because of the bulky nature of the amine, the usual method of preparation through the succinic anhydride will provide the alkenyl group $\beta$ to the carboxamide as the major product. To the extent that this is the more easily accessible derivative, this derivative is preferred. However, as far as operability is concerned, either isomer or a mixture of the two isomers may be used.

Individual compounds or mixtures of compounds may be used. Mixtures of different C- and/or N-substituents, both as to homologs and isomers, will frequently be employed when the individual precursors to the succinamic acid product are not readily available.

Illustrative succinamic acids include N,N-dihexadecyl hexadecylsuccinamic acid, N-hexadecyl, N-octadecyl octadecylsuccinamic acid, N,N-dihexadecenyl $C_{16-20}$-alkenylsuccinamic acid, N-hexadecenyl N-eicosenyl octadecylsuccinamic acid, etc.

As indicated previously, the succinamic acid may be used as its amine salt, preferably as a mixture of acid and amine salt.

The amine salt of acid or mixtures thereof can be represented by the following formula:

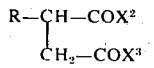

wherein R is as previously defined, one of the $X^2$ and $X^3$ is —$NYY^1$ wherein Y and $Y^1$ have been previously defined. The other of $X^2$ and $X^3$ is of the formula:

$$-OH(NYY^2Y^3)_n$$

wherein $Y^2$ and $Y^3$ may be hydrogen, aliphatic hydrocarbon of from 1 to 30 carbon atoms or oxaliphatic hydrocarbon (there being 1 ethereal oxygen atom present in the radical bonded to nitrogen at least $\beta$ to the nitrogen atom) of from 3 to 30 carbon atoms. $Y^2$ and $Y^3$ may be taken together to form a heterocyclic ring of from 5 to 7 members having nitrogen and oxygen as the only heteromembers, n varies from 0 to 1, preferably from 0.1 to 0.9. That is, from 10 to 90 mole percent of the succinamic acid present is in the form of its salt.

The aliphatic hydrocarbon groups are preferably saturated and if unsaturated usually have no more than 2 sites of ethylenic unsaturation. The total number of carbon atoms for $HNY^2Y^3$ will be from 0 to 60, usually 1 to 40.

The groups indicated for Y and $Y^1$ may also be used for $Y^2$ and $Y^3$. However, as already indicated, primary amines may be used as well as secondary amines to form the salt. Usually, where an amine other than the one used to prepare the succinamic acid is used to form the salt, as will be explained subsequently, there will be a mixture of salts; both the added amine and the secondary amine employed to prepare the succinamic acid will be involved in salt formation.

Illustrative amines which may be used to form salts are di-sec-butyl amine, heptyl amine, dodecyl amine, octadecyl amine, tert-butyl amine, morpholine, diethyl amine, methoxybutylamine, methoxyhexylamine, etc.

The alkenyl succinamic acids of this invention are readily prepared by reacting an alkyl or alkenyl succinic anhydride with the desired secondary amine at a temperature in the range of about 150° to 250°F. in approximately equimolar amounts, either neat or in the presence of an inert solvent. The time for the reaction is generally in the range of 15 minutes to 1 hour. This reaction is well known in the art and does not require extensive discussion here.

The alkyl or alkenyl succinic anhydride which is used may be individual compounds or mixtures of compounds. That is, various alkyl or alkenyl groups of differing number of carbon atoms or different positions of attachment to the succinic anhydride group may be used. Alternatively, a single isomer may be used. Since mixtures are generally more readily available, to that degree they are preferred. Frequently, mixtures will be used of aliphatic hydrocarbyl substituted succinic anhydrides wherein no single homolog is present in amount greater than 25 mole percent, each homolog being present in at least 5 mole percent.

Various secondary amines may be used, both those having the same aliphatic hydrocarbon groups and those having different aliphatic hydrocarbon groups. Either alkyl or alkenyl substituents may be present on the nitrogen, each having at least 14 carbon atoms. The range of difference between the two aliphatic hydrocarbon groups bonded at the nitrogen is not critical, but will generally be fewer than 8 carbon atoms, more usually fewer than 6 carbon atoms. For most part, the aliphatic hydrocarbon groups will be straight chain, i.e., normal, with the amino nitrogen bonded either to internal or terminal carbon atoms.

It is found that when using approximately a 1:1 mole ratio of amine to succinic anhydride, depending on the reaction conditions, a significant amount of amine may be unreacted and remain to form the salt of the succinamic acid which is formed. In some instances, as much as 30 percent of the amine may remain unreacted, forming a significant amount of salt. Thus, the salt will frequently be from 10 to 30 mole percent of the total succinamic acid present.

Also, in situations where significant amounts of water are present during the course of the reaction, the water may react with a succinic anhydride to form succinic acid. If the temperature is not high enough to regenerate the succinic anhydride, the succinic acid will probably remain unreacted or form the amine salt with available unreacted amine. Therefore, the mixture of amic acid salts may be conveniently prepared merely by using a 1:1 mole ratio of amine to succinic anhydride, and not attempting to drive the reaction to completion, or up to a mole excess of amine.

The amine salts are readily prepared by adding the amine to the succinamic acid, conveniently as prepared, or in an inert solvent. Mild heating may facilitate the reaction.

Ethylene Polymer

Another additive which can be usefully admixed with wool fat is an oil soluble, polymer of molecular weight $\overline{M}n$ of 500–50,000 selected from the group consisting of:

an ethylene polymer,
a hydrogenated olefin polymer,
a $C_{10-18}$ olefin polymer,
a halogenated ethylene polymer, and
a polymer of 3–40 moles of ethylene and one mole of a copolymerizable comonomer selected from the group consisting of
i. a vinyl ester of a $C_{1-17}$, preferably $C_{2-9}$ monocarboxylic acid,
ii. an ethylenically unsaturated ester

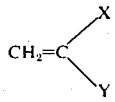

wherein X is H, halogen, or alkyl, Y is halogen or -COOR and R is $C_{1-16}$, preferably $C_{2-8}$ alkyl or aryl,
iii. an ethylenically unsaturated compound

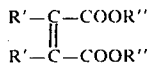

wherein R′ is H or lower alkyl and R″ is H or $C_{1-16}$, preferably $C_{2-8}$ alkyl; and
iv. A $C_{3-18}$, preferably $C_{3-8}$ olefin hydrocarbon.

Within this class a preferred olefin polymer is polyethylene having a molecular weight $\overline{M}n$ of 500–10,000, typically 800–2,500, say 1,500; a preferred halogenated olefin polymer may be chlorinated polyethylene, typically containing 10–30 percent, say 20 percent by weight of chlorine and characterized by a molecular weight $\overline{M}n$ of 500–50,000, more specifically 1,500–15,000, say 5,000; other preferred copolymers are the copolymers of ethylene-propylene containing 3–40 moles of ethylene and one mole of propylene, e.g.

5 moles of ethylene and one mole of propylene, having a molecular weight $\overline{M}n$ of 500–50,000, preferably 1,500–15,000, say 5,000; and, most preferred is the copolymer of about 7 moles of ethylene with one mole of vinyl acetate having a molecular weight of Mn of 2,000. All molecular weight measurements herein are by vapor pressure osmometry.

This oil-soluble flow improving material may be present in amount of 0.001–0.5 parts, preferably 0.005–0.30 parts, say 0.02 parts per 100 parts of oil. For a full discussion of these useful polymers reference should be made to U.S. Pat. No. 3,762,888 incorporated herein by reference thereto.

Cold Filter Plugging Point Test

A test which may be used to determine the flow properties of a middle distillate is the "Cold Filter Plugging Point Test" (CFPPT). This test is carried out by the procedure described in detail in "Journal of the Institute of Petroleum", Volume 52, Number 510, June 1966, pp. 173–185.

In brief, the CFPPT is carried out with a 45 ml. sample of the oil to be tested which is cooled in a bath maintained at about −30°F. Every 2° drop in temperature, starting from 4°F. above the cloud point, the oil is tested with a test device consisting of a pipette to whose lower end is attached an inverted funnel. Stretched across the mouth of the funnel is a 350 mesh screen having an area of about 0.45 square inch. A vacuum of about 7″ of water is applied to the upper end of the pipette by means of a vacuum line while the screen is immersed in the oil sample. Due to the vacuum, oil is drawn across the screen up into the pipette to a mark indicating 20 ml. of oil. The test is repeated with each two degrees F. drop in temperature until the oil fails to fill the pipette to the aforesaid mark due to clogging of the screen with wax crystals. The results of the test are reported as the "operability limit" or cold filter plugging point, which is the temperature in °F. at which the oil fails to fill the pipette in prescribed time.

It is a feature of this invention that the components taught herein to be combined with the wool fat, i.e. the oil-soluble auxiliary flow improving compounds contribute only little or marginal improvement in flow properties when used alone in "difficult" or "unresponsive" fuels such as some of the commonly available European fuels, e.g. a distillate fuel characterized by a 10 percent boiling point of 196°C., a 90 percent boiling point of 339°C., an aniline point of 73°C., a pour point of −21°C., and a cloud point of −3°C. (hereafter described as Fuel C).

Although the wool fat or wool fat and the other component of the additive composition may be separately formulated as a concentrate in a single diluent-solvent; and in the preferred embodiment, the diluent-solvent may be the oil to which the composition is to be added. Typically, this solvent may be a material such as Solvent 325 Neutral, a light lubricating oil base stock, a vacuum gas oil, a heavy aromatic naphtha, Varsol, kerosene, or a distillate heating oil. Other appropriate solvents will be obvious to those skilled in the art.

In the practice of this invention, both the components may be added to a fuel oil in amount (as a mixture in one diluent-solvent or each in a separate diluent solvent) sufficient to improve the flow properties of the oil. Preferably this amount is about 0.002 to 1.0 parts by weight, typically 0.04 parts by weight per 100 parts of oil.

Practice of the process of this invention in accordance with certain of its aspects, may be effected by adding the first and second components (either sequentially or simultaneously) to the oil, and mixing, thereby forming a petroleum oil composition. Mixing may be done continuously or batchwise. Typically, such formulations may be prepared by addding the flow-improving amount of said flow improvers to a body of the oil at a temperature up to 150°C., preferably greater than 38°C. When the first and second component are added as a concentrate in diluent-solvent, the preferred temperature may be 15°–95°C., say 55°C. When the first and second components are added, without diluent-solvent, the preferred temperature may be 65°–150°C., say 90°C.

Practice of this invention will be apparent to those skilled in the art from the following examples wherein, as elsewhere in this specification, all parts are parts by weight.

DESCRIPTION OF PREFERRED EMBODIMENT

In the examples which follow, the following (European source) middle distillate oils (which are either non-responsive or difficultly responsive to prior art flow improvers) were tested:

| Fuel | Boiling Range, °C. | Physical Properties Aniline Point, °C. | Cloud Point, °C. |
|---|---|---|---|
| A | 170–344 | 73 | −15 |
| B | 166–349 | 72 | −6 |
| C | 160–388 | 65 | −1 |
| D | 155–355 | 71 | +1 |
| E | 201–351 | 71 | −10 |

In carrying out the Examples, the following materials were used:

Additive A — This was a concentrate of about 50 wt. % of a light mineral oil and about 50 wt. % of a wax-naphthalene made from 100 parts by weight of n-paraffin wax having a melting point of about 73°C. chlorinated to about 12 wt. % chlorine and condensed with about 8.8 parts naphthalene (Friedel-Crafts).

Additive B — This was a commercially available methacrylate ester copolymer which is predominantly a pour point depressant for lubricating oils and sold by Rohm and Haas under the trade name of Acryloid 150. This is identified as a poly(pentadecyl methacrylate) having a molecular weight ($\overline{M}n$) in the range of 15,000 to 20,000. Acryloid 150 is sold as a clear, viscous concentrate in solvent refined mineral oil of 150 S.U.S. at 37.8°C. The concentrate has a specific gravity of 0.9 and a viscosity of 23,000 S.U.S. at 37.8°C. and contains about 50 wt. % of active ingredient. Preparation of the polymer has been described in U.S. Pat. Nos. 2,091,627 and 2,100,993.

Additive C — This was a concentrate of about 35 wt. % mineral oil and about 65 wt. % of active ingredient which was a mixture of (1) an ethylene-isobutyl acrylate random copolymer, having a molecular weight (VPO) of about 2000, and a relative mole ratio of ethylene to isobutyl acrylate of about 7 to 1, and (2) a succinamic acid prepared according to U.S. Pat. No. 3,544,467 — Example 1, which is the reaction product of a molar amount of a dihydrogenated tallow amine with a molar amount of alkenyl succinic anhydride wherein the alkenyl groups are isomerized $C_{15-20}$ monoolefins. The weight ratio of said copolymer to said succinamic acid is about 1:4.

Additive D — This was an ethylene-vinyl acetate random copolymer having a number average molecular weight of about 1900 as determined by Vapor Pressure Osmometry, having about 1.5 methyl terminated branches (exclusive of the methyl groups in the vinyl acetate) per 1,000 molecular weight of polymer and about 38 wt. % vinyl acetate. The copolymer was prepared by copolymerizing ethylene and vinyl acetate with dilauroyl peroxide at a temperature of about 105°C., under about 1050 psig ethylene pressure in cyclohexane solvent. A typical laboratory preparation of this polymer is as follows:

A three liter stirred autoclave is charged with about 1000 ml. of cyclohexane as solvent and about 100 ml. of vinyl acetate. The autoclave is then purged with nitrogen and then with ethylene. The autoclave is then heated to 105°C. while ethylene was pressured into the autoclave until the pressure is raised to about 1050 psig. Then, while maintaining a temperature of 105°C. and said 1050 psig pressure, about 160 ml/hour of vinyl acetate and about 80 ml/hour of solution consisting of 9 wt. % di-lauroyl peroxide dissolved in 91 wt. % cyclohexane is continuously pumped into the autoclave at an even rate. A total of 320 ml. of vinyl acetate and 11 gm. of peroxide are injected into the reactor over a period of about 2 hours. After the last of said peroxide is injected, the batch is maintained at 105°C. for an additional 10 minutes. Then, the temperature of the reactor contents is lowered to about 60° C., the reactor is depressurized, and the contents are discharged from the autoclave. The empty reactor is rinsed with 1 liter of warm benzene (about 50°C.) which is added to the product. The product is then stripped of the solvent and unreacted monomers on a steam bath overnight by blowing nitrogen through the product.

Further examples of this class of polymers is described in Canadian Pat. No. 882,194. Details of measuring the branching on this type of polymer are given in Journal of Applied Polymer Science Vol. 15, pp. 1737–1742 (1971).

The several fuels Fuels A-E) were subjected to the CFPPT and modified according to this invention by addition of wool fat alone and in combination with the oil-soluble, flow improving compounds and subjected to the CFPPT. The results demonstrate the utility of this invention.

Fuels A and B were found to have CFPPT temperatures of +16°F. and +20°F., respectively. The addition of 0.2 wt. % of wool fat to Fuels A and B decreased the CFPPT of each by 8°F. and 10°F., respectively. The wool fat used herein in all examples was a commercially available product sold by Matheson, Coleman and Bel of Norwood, Ohio as Wool Fat, Anhydrous having a melting point of 36°–42°C.

Further examples illustrative of the invention are set forth in the following Table.

TABLE

| Example | Wool Fat % A.I.* | Additive Name | Additive % A.T.* | CFPPT °F. |
|---|---|---|---|---|
| | | | | Fuel C |
| 1 | — | — | — | +32 |
| 2 | 0.1 | — | — | +20 |
| 3 | 0.2 | — | — | +12 |
| 4 | — | A | 0.015 | +22 |
| 5 | — | B | 0.015 | +30 |
| 6 | — | C | 0.020 | +14 |
| 7 | 0.1 | A | 0.0075 | +6 |
| 8 | 0.1 | B | 0.0075 | +4 |
| 9 | 0.1 | C | 0.020 | +8 |

TABLE-continued

| Example | Wool Fat % A.I.* | Additive Name | Additive % A.T.* | CFPPT °F. |
|---|---|---|---|---|
| | | | | Fuel D |
| 10 | — | — | — | +36 |
| 11 | 0.2 | — | — | +28 |
| 12 | — | A | 0.04 | +28 |
| 13 | — | B** | 0.04 | +32 |
| 14 | 0.1 | A | 0.02 | +18 |
| 15 | 0.1 | B** | 0.02 | +24 |
| 16 | 0.05 | C | 0.07 | +8 |
| | | | | Fuel E |
| 17 | — | — | — | +12 |
| 18 | — | D | 0.05 | +6 |
| 19 | 0.20 | D | 0.05 | +2 |
| 20 | 0.20 | C | 0.05 | 0 |

*Wt. % of active ingredient added to fuel.
**Acryloid 150 - a mixture of $C_{10}$ to $C_{24}$ n-alkyl methyacrylates, averaging $C_{15}$ n-alkyl.

The various blends of the flow improvers were made by simple mixing of the respective concentrates.

It will be apparent to those skilled in the art that varying results may be achieved with respect to difference of the "difficult" fuels by use of selected combinations of additives. Because of the peculiar, widely-varying, and totally unexpected nature of the difficult fuels, it is not always possible to predict the degree of improvement to be attained; and in a few instances the improvement attained with certain combinations may be greater.

Illustrative of this is the combination of wool fat and Additive C, which with Fuel C had a higher CFPPT temperature than wool fat in combination with Additives A or B (compare Examples 9 with 7 and 8) yet in Fuel D the wool fat—Additive C was markedly superior in cold flow improvement over the wool fat — Additive A or B combinations (compare Example 16 with 14 and 15).

The additive flow improvers of the invention may be used alone as the sole oil additive, or in combination with other oil additives such as corrosion inhibitors; antioxidants; sludge inhibitors; etc.

The wool fat alone or as the combined additive flow improver combination (wool fat plus one or more auxiliary flow improving materials) will be usefully present in the oil at a concentration of from about 0.001 to 2.0 parts by weight per 100 parts of oil; preferably within a range of from about 0.002 to 1.0 parts per 100 parts of oil; optimally at a range of from 0.005 to 0.5 parts of total additive per 100 parts of oil.

As noted earlier, the ethylene polymers auxiliary material is itself present when used in an amount of from about 0.001–0.5 parts, preferably 0.005–0.30 parts, say 0.02 parts per 100 parts of oil. These ranges for said polymer usage also are correct concentration ranges to be followed in use of the other auxiliary flow improving materials, i.e. the alkyl aromatics, the ester base polymers and the succinamic acid materials, along with the wool fat to usefully improve the cold flow properties of the oil.

The molecular weight values set forth herein are number average molecular weight ($\overline{M}n$).

The alkyl aromatic is produced by condensation of the aromatic hydrocarbon in a relative weight ratio of about .5 to 15 parts of halogenated wax per part of aromatic hydrocarbon, preferably about 1–10 parts wax per part.

The invention in its broader aspect is not limited to the specific details shown and described and departures may be made from such details without departing from the principles of the invention and without sacrificing its chief advantages.

What is claimed is:

1. A fuel oil improved in its cold flow characteristics, comprising a major proportion of an atmospheric distillate petroleum oil and in the range of 0.01 to 3 wt. % of a synergistic cold flow improving combination of 0.3 to 10 parts by weight of wool fat, per part by weight of an auxiliary oil-soluble flow improving material selected from the group consisting of:

Friedel-Crafts condensation product of wax having a melting point of about 38° to 94°C. halogenated to about .5 to 25 wt. % halogen and condensed with an aromatic hydrocarbon, in a relative weight ratio of about 5 to 15 parts of halogenated wax per part of said hydrocarbon; and ester polymer having a molecular weight in the range of about 5,000 to 1,000,000 and being a polymer of a $C_8$ to $C_{18}$ alkyl ester of $C_3$ to $C_8$ monoethylenically unsaturated acid.

2. A fuel oil according to claim 1, wherein said auxiliary material is said Friedel-Crafts condensation product and wherein said aromatic hydrocarbon is naphthalene.

3. A fuel oil according to claim 1, wherein said auxiliary material is said ester polymer.

4. A fuel oil according to claim 3, wherein said ester polymer is a polymer of alkyl methacrylate, wherein at least 80 wt. % of said polymer is $C_{12}$ to $C_{18}$ straight chain alkyl groups, and the number average molecular weight of said polymer is in the range of about 15,000 to 200,000.

5. A fuel oil according to claim 1, wherein said oil contains about 0.05 to about 0.75 wt. % of said combination, and wherein there are about 0.5 to 5 parts by weight of said wool fat per part by weight of said auxiliary material.

6. An additive blend useful for improving the cold flow characteristics of petroleum fuel oil, comprising mineral oil containing from about 3 to 60 wt. % of a cold flow improving combination of 0.3 to 10 parts by weight of wool fat per part by weight of an auxiliary oil-soluble flow improving material selected from the group consisting of:

Friedel-Crafts condensation product of wax having a melting point of about 38° to 94°C. halogenated to about 0.5 to 25 wt. % halogen and condensed with an aromatic hydrocarbon, in a relative weight ratio of about 5 to 15 parts of halogenated wax per part of said hydrocarbon; and ester polymer having a molecular weight in the range of about 5,000 to 1,000,000 and being a polymer of a $C_8$ to $C_{18}$ alkyl ester of $C_3$ to $C_8$ monoethylenically unsaturated acid.

* * * * *